United States Patent [19]

Iwata et al.

[11] Patent Number: 4,951,639

[45] Date of Patent: Aug. 28, 1990

[54] ROTATIONAL POSITION DETECTOR DEVICE FOR AN INTERNAL COMBUSTION ENGINE

[75] Inventors: Toshio Iwata; Wataru Fukui, both of Himeji, Japan

[73] Assignee: Mitsubishi Denki Kabushiki Kaisha, Tokyo, Japan

[21] Appl. No.: 417,943

[22] Filed: Oct. 6, 1989

[30] Foreign Application Priority Data

Oct. 6, 1988 [JP] Japan ..... 63-250910

[51] Int. Cl.[5] ..... F02P 5/04

[52] U.S. Cl. ..... 123/613

[58] Field of Search ..... 123/613, 612, 594, 618, 123/416, 417, 418, 643

[56] References Cited

U.S. PATENT DOCUMENTS

| | | | |
|---|---|---|---|
| Re. 31,709 | 10/1984 | Ford | 123/416 |
| 3,407,796 | 10/1968 | Hetzler | 123/613 |
| 3,421,488 | 1/1969 | Tarter | 123/613 |
| 3,976,044 | 8/1976 | Madeira et al. | 123/613 |
| 4,700,305 | 10/1987 | Lotterbach et al. | 364/431.03 |
| 4,747,389 | 5/1988 | Yuzawa et al. | 123/613 |

*Primary Examiner*—Raymond A. Nelli

*Attorney, Agent, or Firm*—Sughrue, Mion, Zinn, Macpeak and Seas

[57] ABSTRACT

A rotational position detector for detecting the position of the crankshaft of a multi-cylinder internal combustion engine is disclosed. A signal generator generates pulses whose leading and trailing edges correspond to the first and second rotational positions of the crankshaft with respect to the respective cylinders. The first and the second rotational positions are at 75 degrees BTDC and 5 degrees BTDC with respect to respective cylinders; however, the second rotational position of the crankshaft with respect to a particular cylinder (cylinder No. 1) is displaced to the retarding side by 10 degrees, i.e. to 5 degrees ATDC. Thus, those pulses which correspond to cylinder No. 1 is identified as follows: first, the duty ratio t/T of the pulse width t to the period T between the leading edges of the two successive pulses is calculated; then, the duty ratio t/T is compared with a predetermined reference level to identify the pulses corresponding to cylinder No. 1.

4 Claims, 4 Drawing Sheets

ROTATIONAL POSITION DETECTOR DEVICE FOR AN INTERNAL COMBUSTION ENGINE

BACKGROUND OF THE INVENTION

This invention relates to detectors for detecting the rotational position of the crankshaft of an internal combustion engine, and more particularly to such rotational position detectors which are capable of determining the position of the crankshaft in relation to the respective cylinders of a multi-cylinder engine.

It is becoming increasingly common in the automotive engines to control the ignition or the fuel injection system by means of a microcomputer. In such control of the ignition or the fuel injection system by means of a computer, precise detection of the rotational position of the crankshaft is essential. Thus, computer-based engine control systems are generally provided with a rotational position signal generator for detecting the rotation of the cramshaft or the crankshaft of the engine. In the case of multi-cylinder engines, the rotational position signal generally comprises pulses which respectively correspond to the position of the crankshaft in relation to the respective cylinders; thus, for the purpose of identifying which pulse corresponds to which cylinder, a reference or cylinder-identifying signal which discriminates those pulses corresponding to a particular reference cylinder must also be provided.

FIGS. 1 and 2 show an example of a rotational position signal generator for detecting the position of the crankshaft of a four-cylinder four-stroke internal combustion engine. In FIG. 1, a shaft 1 of the signal generator, coupled, for example, to the camshaft of the engine, rotates in synchrony with the crankshaft, to complete one revolution (360 degrees) as the crankshaft makes two revolutions (720 degrees). In this connection, let us note that a four-stroke engine completes a complete cycle of suction, compression, combustion, and exhaustion in two revolutions (or the rotation of 720 degrees) of the crankshaft. A rotor disk 2 mounted on the shaft 1 has four elongated windows 3 formed at a predetermined radial distance from the center at four circumferential locations corresponding to the predetermined rotational positions of the crankshaft in relation to the respective four cylinders of the engine. The disk 2 further comprises an elongated window **3*a* for identifying a particular cylinder (hereinafter, cylinder No. 1). The light emitted from a light-emitting diode 4 is received by a photodiode 5 via the windows 3 when they pass therebetween; similarly, the light emitted from a light-emitting diode 4*a* is received by a photodiode 5*a* when the window 3*a* passes therebetween. As shown in FIG. 2, the output signal of the photodiode 5 or 5*a* is amplified by an amplifier circuit 6, to be supplied to an output transistor 7** having an open collector.

FIG. 3 shows the waveforms of the two output signals of the signal generator of FIG. 1: the cylinder-identifying signal SGC shown at the top row (a) originates from the photodiode **5*a*; on the other hand, the crankshaft rotational position signal SGT shown below at (b) originates from the photodiode 5. The crankshaft position signal SGT comprises pulses whose leading and trailing edges correspond to the first and second predetermined rotational positions (e.g., 75 degrees and 5 degrees before the top dead center (BTDC) between the compression and the combustion (i.e., power) stroke) of the crankshaft with respect to the respective four cylinders. On the other hand, the cylinder-identifying signal SGC consists of pulses which are generated in synchrony with those pulses of the position signal SGT that correspond to the cylinder No. 1 (the particular or specified cylinder); thus, the pulses of the cylinder-identifying signal SGC are utilized to identify those pulses of the position signal SGT that correspond to the cylinder No. 1**.

As shown further in FIG. 4, these output signals SGC and SGT of the rotational position signal generator 8 are supplied via an interface circuit 9 to the microcomputer 10 which controls the ignition and the fuel injection system, etc. With the help of the cylinder-identifying signal SGC, the microcomputer 10 can determine which one of the pulses of the position signal SGT corresponds to which one of the cylinders of the engine; thus, it can correctly determine the ignition timing, etc., of respective cylinders on the basis of the output signals SGC and SGT of the signal generator 8.

The above type of rotational position detectors, however, has the following disadvantage. Namely, since the rotational position signal generator must be provided with two separate and distinct signal generating systems for generating the two signals (i.e., the crankshaft rotational position signal SGT and the cylinder-identifying signal SGC), the organization thereof becomes complicated and the production cost is increased.

SUMMARY OF THE INVENTION

Thus, it is a primary object of this invention to provide a rotational position detector device for a multicylinder internal combustion engine which is capable of determining the rotational position of the crankshaft with respect to the respective cylinders on the basis of a single rotational position signal. More particularly, it is an object of this invention to provide a rotational position detector which is capable of accurately and reliably identifying the rotational position pulses relating to a particular cylinder on the basis of a single rotational position signal.

The above objects are accomplished in accordance with the principles of this invention in a rotational position detector comprising a rotational position signal generator which generates pulses whose leading and trailing edges indicate the first and the second rotational positions of the crankshaft with respect to the respective cylinders of the engine. The first rotational positions of the crankshaft with respect to the respective cylinders are equal to each other (e.g., 75 degrees before the top dead center between a compression and a power stroke); the second rotational positions of the crankshaft, which occur after the respective first rotational positions, are equal to each other (e.g., 5 degrees before the top dead center between a compression and a power stroke) with respect to the respective cylinders, except for one particular cylinder (cylinder No. 1): the second rotational position of the crankshaft with respect to the particular cylinder (cylinder No. 1) is displaced to the retarding direction by a predetermined amount (e.g, by 10 degrees, so that it is displaced to 5 degrees after the top dead center between a compression and a power stroke) compared with the second rotational positions of the crankshaft with respect to other cylinders.

Further, the identification of the pulses which relate to the particular cylinder (cylinder No. 1) is effected on the basis of the duty ratio of the pulses as follows: first, the pulse width t (i.e., the length of time between the leading and trailing edge thereof) and the period T between the leading edges of two successive pulses are measured; then, the duty ratio t/T is calculated and compared to a predetermined level; and those pulses that have a duty ratio t/T greater than the predetermined level are determined to be those that correspond to the particular cylinder (cylinder No. 1).

Generally, the leading edges of the pulses corresponding to the first rotational positions of the crankshaft in relation to the respective cylinders are utilized as reference points in the determination of the ignition, timings, etc.; further, although the second rotational positions may be utilized for the determination of the ignition timings during the starting period of the engine, the displacement of the second rotational position with respect to the particular cylinder is to the retarding direction. Thus, the displacement of the second rotational position with respect to the particular cylinder has practically no adverse effects on the accurate determination of the ignition timing. Furthermore, since the pulses relating to the particular cylinder are identified on the basis of the duty ratio thereof, such identification can be effected accurately and reliably even when the rpm of the engine varies.

BRIEF DESCRIPTION OF THE DRAWINGS

The novel features which are believed to be characteristic of this invention are set forth with particularity in the appended claims. This invention itself, however, both as to is organization and method of operation, together with further objects and advantages thereof, may best be understood from the following detailed description of the preferred embodiments, taken in connection with the accompanying drawings, in which:

In the drawings, like reference numerals represent like or corresponding parts or portions.

DETAILED DESCRIPTION OF THE PREFERRED EMBODIMENT

Figure 1:
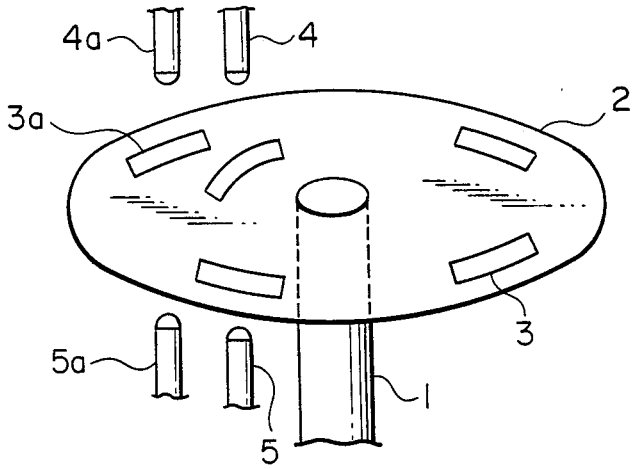
FIG. 1 is a schematic perspective view of a conventional rotational position signal generator of the optical transducer type.
Figure 2:
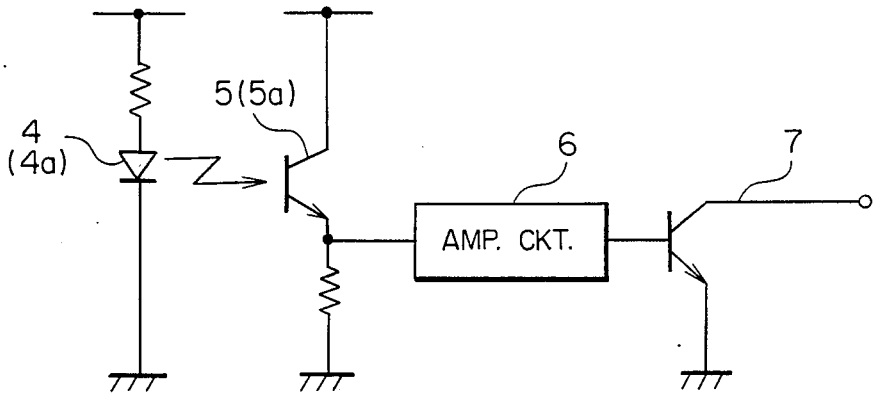
FIG. 2 is a circuit diagram showing the circuit organization of a signal generator of the optical tranducer type.
Figure 3:
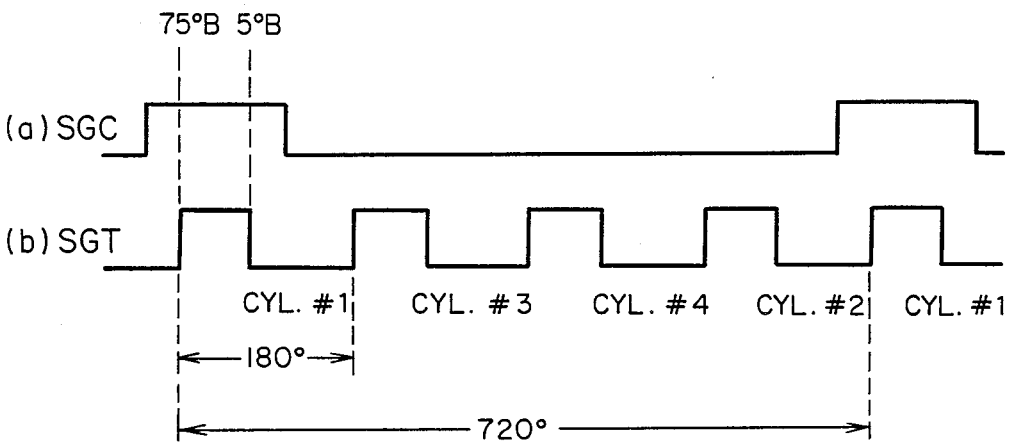
FIG. 3 shows waveforms of the output signals of the signal generator of FIG. 1.
Figure 4:
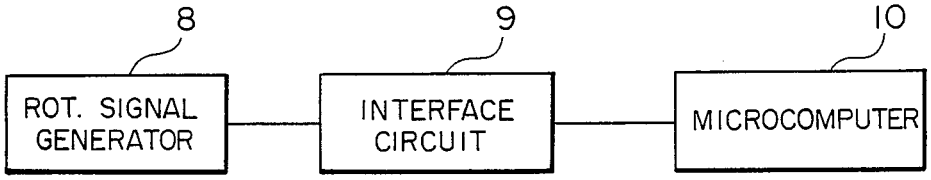
FIG. 4 is a block diagram showing the organization of a control system for an automotive engine including a microcomputer and a rotational position signal generator.
Figure 5:
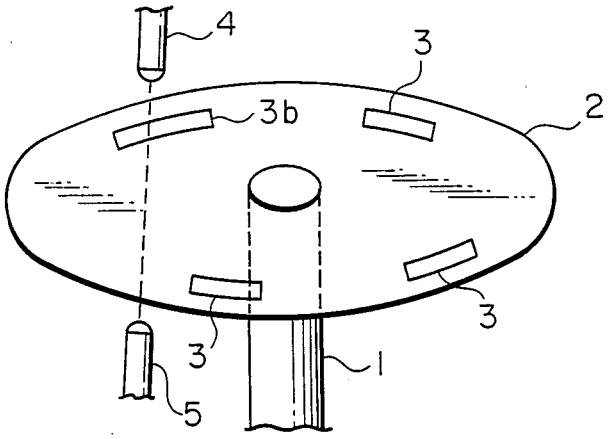
FIG. 5 is a schematic perspective view of a rotational position signal generator of the optical transducer type according to this invention.
Figure 6:
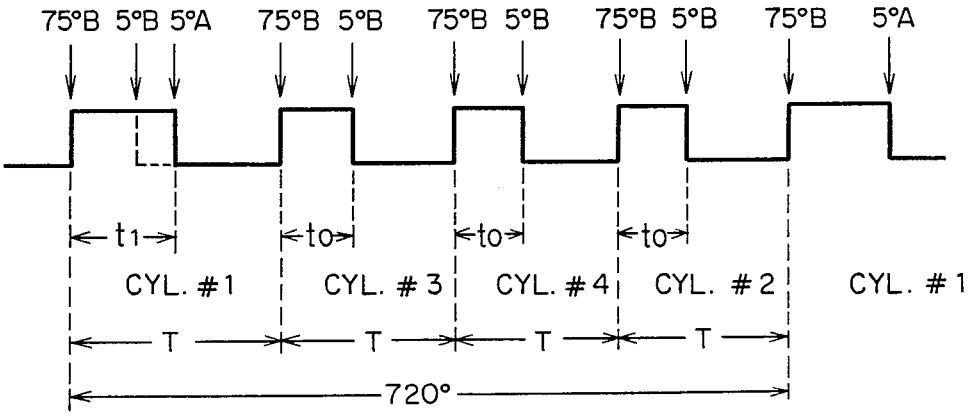
FIG. 6 shows the waveform of the output signal of the signal generator of FIG. 5.

Referring now to FIGS. 5 through 6 of the drawings, an embodiment of the rotational position detector device according to this invention for detecting the rotational position of the crankshaft of an internal combustion engine is described; in the description, reference is also made to FIGS. 2 and 4. Although the following description is made in the case where the engine is a four-cylinder four-stroke engine, it will be clear to those skilled in the art that this invention is applicable to the rotational position detectors for any multi-cylinder engines.

FIG. 5 shows a schematic perspective view of an example of the rotational position signal generator according to this invention. A shaft 1, coupled, for example, to a camshaft of the engine, rotates in synchrony with the crankshaft, to complete one revolution (360 degrees) as the crankshaft makes two revolutions (720 degrees). A rotor disk 2 mounted on the shaft 2 has four elongated windows 3 and 3*b* formed at a predetermined radial distance from the center thereof; they are formed at four circumferential locations corresponding to the predetermined rotational positions of the crankshaft with respect to the respective four cylinders of the engine. However, as will become clear below by reference to FIG. 6, the rear edge (corresponding to the retarding side) of one of the windows, labeled 3*b* and corresponding to cylinder No. 1, is extended further to the rear by a predetermined circumferential angle than the rear edges of other windows 3 corresponding to cylinders No. 2 through 4. The light emitted from a light-emitting diode 4 is received by a photodiode 5 via the windows 3 and 3*b* when they pass therebetween. As shown in FIG. 2, the output signal of the photodiode 5 is amplified by an amplifier circuit 6, to be supplied to an output transistor 7 with an open collector.

FIG. 6 shows the waveform of the output position signal of the signal generator of FIG. 5. In one complete cycle of 720 degrees, four pulses are generated which corresponds to the rotational position of the crankshaft with respect to the four cylinders: cylinders No. 1, No. 3, No. 4, and No. 2, in that order, as shown in the figure. The leading and the trailing edges of the pulses correspond, respectively, to the first and second rotational positions of the crankshaft in relation to the respective cylinders. In the case of the three pulses corresponding to cylinders Nos. 3, 4, and 2, the first and second predetermined rotational positions are equal to each other (e.g., 75 degrees and 5 degrees, respectively, before the top dead center between the compression and the combustion (or power) of the crankshaft with respect to the respective three cylinders. On the other hand, in the case of the pulse corresponding to cylinder No. 1, the second rotational position to which the tailing edge thereof corresponds is displaced by a predetermined angle (e.g., 10 degrees) to the retard side, to be displaced to 5 degrees ATDC (after top dead center); the first rotational position to which the leading edge thereof corresponds is at 75 degrees BTDC (before top dead center) as in the case of the other three pulses. Thus, the leading edges of all the four pulses are generated at the same first rotational position of the crankshaft (i.e., 75 degrees BTDC) with respect to the four cylinders; only the trailing edge of the pulse corresponding to the cylinder No. 1 is displaced to the retarding direction, compared with the trailing edges of the pulses corresponding to the other cylinders.

As shown in FIG. 4, the rotational position signal shown in FIG. 6 is supplied via an interface circuit 9 to the microcomputer 10 which controls the ignition and the fuel injection system, etc. Generally, the microcomputer 10 determines, for example, the ignition timings of the four cylinders on the basis of the leading edges of the pulses of the rotational position signal, so that the same rotational position (i.e., 75 degrees BTDC) of the crankshaft with respect to the respective cylinders is utilized as the reference position. In the cranking (i.e. starting) period of the engine, however, the ignition is effected utilizing as the reference points the trailing edges of the pulses of the position signal of FIG. 6; although the trailing edge of the pulse corresponding to cylinder No. 1 is displaced to the retard side by 10 degrees, this will not adversely affect the starting operation since the displacement is to the retarding direction.

Figure 7:
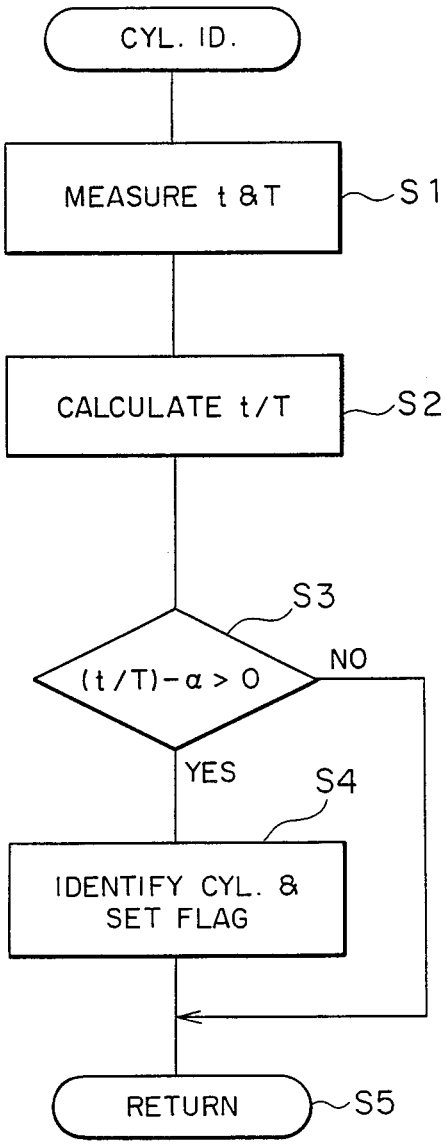
FIG. 7 is a flowchart showing the routine for identifying those pulses of the waveform of FIG. 6 that correspond to a particular cylinder.

The identification of the cylinders corresponding to respective pulses of the signal of FIG. 6 is effected by means of a routine shown in FIG. 7, according to which the pulse corresponding to the particular cylinder, i.e., cylinder No. 1, is identified on the basis of the difference in the duty ratio of the pulses. First, at step S1, the microcomputer 10 determines the width t of a pulse (i.e., the length of time at which it is at the high level), and the period T from the leading edge thereof to the leading edge of the next pulse. Next, at step S2, it calculates the duty ratio t/T on the basis of the values of the pulse width t and the period T determined at the preceding step S1. It is noted in this connection that, as shown in FIG. 6, the pulse width t0 of the three pulses corresponding to cylinders No. 2 through 4 is smaller than that t1 of the pulse corresponding to the cylinder No. 1, while the period T between the leading edges of the four pulses remains constant. Thus, at the next step S3, the duty ratio t/T calculated at step S2 is compared to a predetermined value $\alpha$ (which is selected at a value between t0/T and t1/T: $t0/T<\alpha<t1/T$) to determine whether or not t/T is greater than $\alpha$; namely, it is judged whether or not the following inequaltity holds:

$$(t/T)-\alpha>0.$$

If the judgement at step S3 is in the affirmative, it is determined that the current pulse corresponds to the particular cylinder, cylinder No. 1; accordingly, the program proceeds to step S4 and the flag is set at the registor corresponding to cylinder No. 1. Thereafter, the program returns to the first step, as indicated at step S5. On the other hand, if the judgement at step S3 is in the negative, the program returns directly to the first step. After the particular cylinder (cylinder No. 1), the pulses corresponding to respective cylinders succeed in a fixed order; namely, in the example shown in FIG. 6, the pulses corresponding to cylinders Nos. 3, 4, and 2 follow the pulse corresponding to cylinder No. 1, in that order. Thus, the correspondance of the cylinders No. 3, 4, and 2 with the subsequent pulses can be determined on the basis of the order of succession. By the way, it should be noted that since the cylinder identification according to the routine of FIG. 7 is based on the duty factor of the pulses, the identification can be carried out accurately even when the rpm of the engine varies.

While description has been made of the particular embodiment of this invention, it will be understood that many modifications may be made without departing from the spirit thereof; the appended claims are contemplated to cover any such modifications as fall within the true spirit and scope of this invention.

What is claimed is:

1. A rotational position detector device for detecting a rotational position of a crankshaft of a multicylinder internal combustion engine, said detector device comprising:

a signal generator means, operatively coupled to the crankshaft of the internal combustion engine, for generating pulses whose leading and trailing edges correspond to first and second rotational positions of the crankshaft of the internal combustion engine with respect to respective cylinders, thereof, said second positions occurring after respective first positions in a neighborhood of a top dead center between a compression stroke and a combustion stroke of respective cylinders, said first positions of the crankshaft being equal to each other with respect to all the cylinders of the engine, said second positions of the crankshaft being equal to each other with respect to the cylinders except for a predetermined particular cylinder, wherein the second rotational position of the crankshaft with respect to the predetermined particular cylinder is displaced to a retarding side compared with the second rotational positions of the crankshaft with respect to the cylinders other than said predetermined particular cylinder; and cylinder identifying means, coupled to said signal generator means, for determining those pulses of said signal generator means whose leading and trailing edges correspond to the first and the second rotational positions of the crankshaft with respect to said predetermined particular cylinder, wherein said cylinder indentifying means includes:

first time measurement means, coupled to said signal generator means, for determining a pulse width of each pulse of the signal generator means;

second time measurement means, coupled to said signal generator means, for determining each period between leading edges of two successive pulses;

calculation means, coupled to said first and second time measurement means, for calculating each ratio of the pulse width to the period between leading edges of two successive pulses; and comparison means, coupled to said calculation means, for comparing to a predetermined level each ratio of the pulse width to the period between leading edges of two successive pulses, wherein pulses having said ratio greater than said predetermined level are judged to be those whose leading and trailing edges correspond to the first and the second rotational position of the crankshaft with respect to said predetermined particular cylinder.

2. A rotational position detector device as claimed in claim 1, wherein said pulses of the signal generator means rises from a low to a high level at said leading edges thereof and falls from the high to the low level at said trailing edges thereof.

3. A rotational position detector device as claimed in claim 1 or 2, wherein said signal generator means comprises:

a rotor disk operatively coupled to the crankshaft of the internal combustion engine to be rotated in synchrony therewith; and means for generating said pulses of the signal generator means in response to a rotation of said rotor disk.

4. A rotational position detector device as claimed in claim 1 or 2, wherein ignition timings of the internal combustion engine are determined on the basis of said first positions of the crankshaft with respect to respective cylinders.

* * * * *